United States Patent [19]

Gay

[11] 4,345,444

[45] Aug. 24, 1982

[54] METALLIC BRACELET

[75] Inventor: Jacques-Hubert Gay, Geneva, Switzerland

[73] Assignee: Gay Freres S.A., Geneva, Switzerland

[21] Appl. No.: 189,137

[22] Filed: Sep. 22, 1980

[30] Foreign Application Priority Data

Oct. 1, 1979 [CH] Switzerland ..... 8825/79

[51] Int. Cl.[3] ..... A44C 5/08; A44C 5/24

[52] U.S. Cl. ..... 63/4; 24/68 J; 24/265 BC; 24/265 WS

[58] Field of Search ..... 63/3, 4, 5; 24/265 BC, 24/265 WS, 68 J, 69 J, 71 R, 71 J, 70 J

[56] References Cited

U.S. PATENT DOCUMENTS 1,781,101 11/1930 Carlson ..... 24/71 J

FOREIGN PATENT DOCUMENTS 1470984 4/1977 United Kingdom ..... 24/265 WS

*Primary Examiner*—F. Barry Shay

*Attorney, Agent, or Firm*—Mandeville and Schweitzer

[57] ABSTRACT

At one of the extremities of the bracelet, which is formed of two rows of rectangular side links (1,2) and of a middle row of rectangular wider links (3), is arranged an end piece (6) having the appearance of two side links and of a middle link. This piece (6) is fixed to a clasp (5) by the intermediary of a slide (7). The piece (6) presents a series of lateral holes and the slide a corresponding hole which one can bring, according to choice, face to face with one or the other of the holes of the piece (6) in order to exactly adapt the length of the bracelet to the wrist. A pin driven into the holes which coincide secures (6) and (7) with regard to one another. Thus finds itself made possible the precise adjusting of the length of bracelets with large rectangular links.

9 Claims, 3 Drawing Figures

FIG. 1
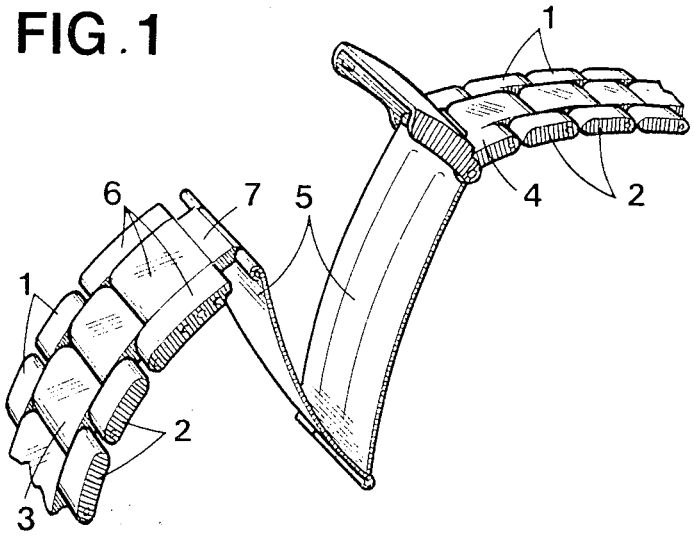
FIG. 2
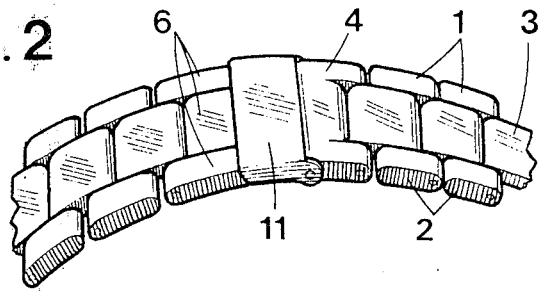
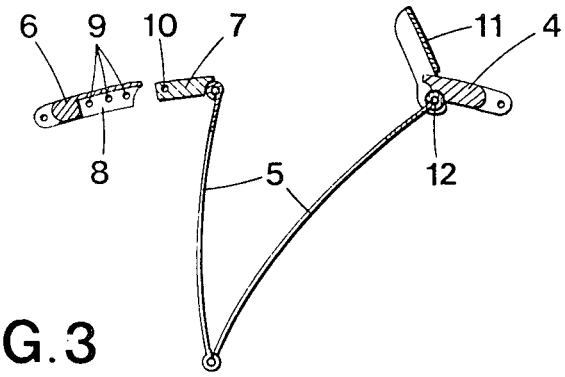
FIG. 3

METALLIC BRACELET

The present invention has as object a metallic bracelet of the type with large articulated links of generally rectangular form, arranged in adjoining rows. In order to adjust the length of such bracelets so that they are adapted to the thickness of the wrist of the user, one can proceed only by removal or addition of a whole number of links, which makes accurate adaption difficult. Indeed such links often have a length measured in the longitudinal direction of the bracelet in the order of a centimeter and one understands that an adjustment near a centimeter is not satisfactory.

The present invention aims to remedy this defect by permitting a much finer adjustment. For this, the bracelet comprises, at one of its extremities intended to be fixed to a clasp, an end piece having the external appearance of side links and of at least one middle link, and a slide provided for engagement in the middle part of this piece, some means being provided for securing the slide in a chosen one of several possible positions in the said piece, in order to adjust the bracelet to the wrist, the slide being provided for fixing to the clasp.

The annexed drawing illustrates by way of example one embodiment of the bracelet according to the invention.

FIG. 1 is a view in perspective of the bracelet, the clasp being open.

FIG. 2 is another view in perspective, the clasp being in closed position.

FIG. 3 is a view in cross section of the clasp and of the adjacent parts of the bracelet.

The illustrated bracelet is formed of three adjacent rows of links, being two side rows of links 1,2 and a middle row of links 3. All these links are of large size and of generally rectangular form, the side links being narrower than the middle links. These links are articulated between themselves in known fashion. At its right hand extremity on the drawing, the bracelet ends at a piece 4 imitating the external appearance of the links and fixed to the extremity of an articulated clasp 5 of known type. At its opposite extremity intended to be fixed to the clasp 5 and visible on the left part of the drawing, the bracelet is furnished with an end piece 6 having the external appearance of two side links 1,2 and of a middle link 3. The bracelet comprises in addition a slide 7 intended to be fixed to the clasp 5 and which is provided in order to slide in a groove 8 of the piece 6, as one understands by examining FIG. 3. A series of holes 9, to the number of three in the illustrated example, are provided laterally and on edge in the piece 6. A corresponding hole 10 extends laterally and on edge in the slide 7. By means of a pin one can therefore secure the slide 7 in one of three possible positions, by driving this pin into one of the holes 9 and across the hole 10. Certainly, the number of adjusting holes can be in excess of three.

A cover 11, which includes fastening means 13 for holding the cover 11, the end piece 6 and the clasp 5 in overlapping relation, is pivotally mounted around a spindle 12, both on the piece 4 and on one of the extremities of the clasp 5. This cover is intended to be pressed down over the slide 7 and a part of the piece 6 when the clasp is in position of closure, as one sees on FIG. 2, in order to conceal from view the slide 7.

In a variant, there can be more than one middle row of links such as 3. The pieces 4 and 6 would then be modified in consequence.

I claim:

1. A bracelet and extension apparatus comprising (a) a link portion having articulated links of generally rectangular form and generally equal length arranged in adjoining rows of side links and middle links, (b) an end piece having the external appearance of said side links and of at least one said middle link, (c) said end piece being situated at one of the extremities of said link portion, (d) a slide slideably moveable within the middle part of the end piece, and (e) slide piece securing means for securing the slide piece in a chosen one of several possible positions in said end piece in order to adjust the bracelet to the wrist, adjacent ones of said positions being spaced from each other by less than the length of one of said links, (f) the slide piece being adaptable for attachment to a clasp.

2. Bracelet extension apparatus according to claim 1, wherein said slide piece securing means comprise (a) a series of holes provided laterally and on edge in the end piece, (b) a corresponding hole in the slide piece, and (c) a pin which can be accommodated by said holes.

3. Bracelet extension apparatus according to claim 1, wherein each said link is 1 cm in length or greater.

4. Bracelet extension apparatus according to claim 1, further comprising (a) a cover pivotally mounted at the other extremity of the link portion and adapted for attachment to the clasp, (b) said cover being pivotable to a position over the slide piece in order to conceal said slide piece from view when the clasp is closed.

5. Bracelet extension apparatus according to claim 4, wherein said cover is imitative of the appearance of said links.

6. Bracelet extension apparatus according to claims 1 or 4 or 3, wherein said bracelet extension apparatus is metallic.

7. A bracelet comprising (a) a link portion having articulated links of generally rectangular form and generally equal length arranged in adjoining rows of side links and middle links, (b) an end piece having the external appearance of said side links and of at least one said middle link, (c) said end piece being situated at one of the extremities of said link portion, (d) a slide piece slideably moveable within the middle part of the end piece, (e) slide piece securing means for securing the slide piece in a chosen one of several possible positions in said end piece in order to adjust the bracelet to the wrist, adjacent ones of said positions being spaced from each other by less than the length of one of said links, (f) the slide piece being adaptable for attachment to a clasp, (g) clasp means attaching the slide piece to the other extremity of said link portion, and (h) a cover pivotally mounted at the other extremity of the link portion and attached to the clasp, (i) said cover being pivotable to a position over the slide piece in order to conceal said slide piece from view when the clasp is closed.

8. Bracelet according to claim 7, wherein said slide piece securing means comprise (a) a series of holes provided laterally and on edge in the end piece, (b) a corresponding hole in the slide piece, and (c) a pin which can be accommodated by said holes.

9. Bracelet according to claim 7, wherein each said link is 1 cm in length or greater.

* * * * *